US007991534B2

(12) United States Patent
Seel et al.

(10) Patent No.: US 7,991,534 B2
(45) Date of Patent: Aug. 2, 2011

(54) METHOD AND DEVICE FOR OPERATING A DRIVE UNIT

(75) Inventors: Andreas Seel, Hemmingen (DE); Michael Muhler, Eberdingen (DE); Michael Glora, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 805 days.

(21) Appl. No.: 12/077,606

(22) Filed: Mar. 19, 2008

(65) Prior Publication Data

US 2008/0249696 A1 Oct. 9, 2008

(30) Foreign Application Priority Data

Mar. 20, 2007 (DE) ..... 10 2007 013 253

(51) Int. Cl.
*F02D 41/16* (2006.01)

(52) U.S. Cl. ..... 701/102; 123/339.16

(58) Field of Classification Search ..... 701/101, 701/102; 123/339.1, 339.14, 339.16–339.18
See application file for complete search history.

(56) References Cited

U.S. PATENT DOCUMENTS 5,929,533 A * 7/1999 Streib ..... 123/339.1
5,992,382 A * 11/1999 Bruedigam et al. ..... 123/396
6,236,925 B1 * 5/2001 Gierling et al. ..... 701/51
6,810,852 B2 * 11/2004 Schuster et al. ..... 123/339.14
7,083,543 B2 * 8/2006 Loeffler et al. ..... 477/107
7,222,604 B2 * 5/2007 Anz ..... 123/339.14
7,698,050 B2 * 4/2010 Ludwig et al. ..... 701/104
7,813,868 B2 * 10/2010 Zell et al. ..... 701/112
7,840,337 B2 * 11/2010 Zillmer et al. ..... 701/114
2002/0152007 A1 * 10/2002 Huber et al. ..... 701/1
2004/0187841 A1 * 9/2004 Matischok et al. ..... 123/339.14
2006/0213186 A1 * 9/2006 Pott ..... 60/285
2007/0266711 A1 * 11/2007 Falkenstein et al. ..... 60/702

* cited by examiner

*Primary Examiner* — Hieu T Vo
*Assistant Examiner* — Arnold Castro
(74) *Attorney, Agent, or Firm* — Kenyon & Kenyon LLP

(57) ABSTRACT

A method and a device for operating a drive unit which enable better torque coordination for a speed controller. A load-reversal damping component is provided, which filters a first setpoint value for an output variable of the drive unit to damp a load reversal. A speed controller is provided, which specifies a second setpoint value for the output variable of the drive unit in order to adjust an actual value for an engine speed of the drive unit to a setpoint value for the engine speed. A first component of the second setpoint value for the output variable specified by the speed controller is taken into account in the formation of the first setpoint value. A remaining second component of the second setpoint value for the output variable specified by the speed controller, together with the filtered first setpoint value, is taken into account only when forming a resulting third setpoint value for the output variable, the first component of the second setpoint value for the output variable specified by the speed controller being formed as a function of at least one characteristic of the load-reversal damping component, in such a way that it is not or only negligibly affected by the filtering.

12 Claims, 3 Drawing Sheets

METHOD AND DEVICE FOR OPERATING A DRIVE UNIT

CROSS REFERENCE

This application claims benefit, under 35 U.S.C. §119, of German Patent Application 102007013253.2 filed on Mar. 20, 2007, which is expressly incorporated herein by reference in its entirety.

FIELD OF THE INVENTION

The present invention relates to a method and a device for operating a drive unit.

BACKGROUND INFORMATION

Motor vehicles having an internal combustion engine use what is generally known as idle speed control. The purpose of this idle speed control is to keep the internal combustion engine at a specific minimum engine speed, referred to as idling speed or setpoint idling speed, when the driver is not requesting any torque or too low a torque, i.e., when the driving pedal is not actuated. In the process, an actual value for the engine speed is compared to the setpoint idling speed, and a corresponding second setpoint torque is calculated as output variable of the idle-speed controller so as to adjust the actual value for the engine speed to the setpoint idling speed.

This setpoint torque of the idle speed controller is usually incorporated at the end of a torque coordination to ensure that no other torque-influencing function, such as driver-assistance systems or filtering for load-reversal damping, for example, modifies this second setpoint torque. Filter means, which filter a first setpoint torque of the internal combustion engine, are provided for load-reversal damping.

SUMMARY

A method and a device according to example embodiments of the present invention for operating a drive unit may have the advantage that a first component of the second setpoint value for the output variable specified by the speed controller is taken into account in the formation of the first setpoint value, and that a remaining second component of the second setpoint value for the output variable specified by the speed controller together with the filtered first setpoint value is taken into account only when forming a resulting third setpoint value for the output value, the first component of the second setpoint value for the output variable specified by the speed controller being formed as a function of at least one characteristic of the load-reversal damping component, in such a way that it is not or only negligibly affected by the filtering. In this way the first component of the second setpoint value for the output variable specified by the speed controller constitutes a stationary component of the second setpoint value for the output variable specified by the speed controller. Since the stationary component is taken into account in the formation of the first setpoint value, the stationary component is likewise taken into account in the filtering for the load-reversal damping. As a result, given an active speed controller, the function of the load-reversal damping is implementable in a more precise manner, without the intervention of the speed controller being affected to any significant degree by the function of the load-reversal damping.

Also other vehicle functions that affect the first setpoint value for the output variable like the load-reversal damping function are able to be made more precise in their effect if, for example, the first component of the second setpoint for the output variable specified by the speed controller is taken into account when forming the first setpoint value. This is true especially in a drive of a hybrid vehicle having a combustion engine and an electromotor in which, according to a hybrid strategy, the first setpoint value for the output variable is subdivided into a setpoint value for the electromotor and into a setpoint value for the combustion engine, in which case it is especially important to already consider the influence of the second setpoint value specified by the speed controller when splitting the first setpoint value for the output variable between the electromotor and the combustion engine. This improves the load strategy of a hybrid vehicle, and the effectiveness of the hybrid vehicle is increased.

It may be especially advantageous if the first component of the second setpoint value for the output variable specified by the speed controller is formed by filtering the second setpoint value for the output variable. In this way the first component of the second setpoint value for the output variable specified by the speed controller is able to be determined in an especially simple manner and with a minimum of effort.

The filtering is easily implementable with the aid of a low pass, preferably employing a proportional timing element. This also ensures that the remaining second component of the second setpoint value for the output variable specified by the speed controller is average-value-free as an average in time. This is especially advantageous in the case of hybrid vehicles because the remaining second component of the second setpoint value for the output variable specified by the speed controller is unable to falsify the load strategy of the hybrid vehicle if it is taken into consideration only after the first setpoint value for the output variable has been split between the electromotor and the combustion engine as a result of the hybrid strategy.

Another advantage results if a transfer function that is inverse to the transfer function of the means for load-reversal damping is selected for the filtering of the second setpoint value for the output variable. This ensures complete compensation of the influence of the filtering for load-reversal damping on the first component of the second setpoint value for the output variable specified by the speed controller, so that no undesired adverse effect on the second setpoint value specified by the speed controller is able to occur by the filtering for load-reversal damping.

It may be especially advantageous if a time constant is selected for the filtering of the second setpoint value for the output variable that is greater, in particular at least ten times greater, than the time constant induced by the filtering implemented by the means for load-reversal damping, so that the first component of the second setpoint value for the output variable specified by the speed controller is not affected to any significant degree by the filtering by the means for load-reversal damping. In this way the determination of the first component of the second setpoint value specified by the speed controller is able to be realized in an especially simple manner and with negligible losses in accuracy.

The same applies if a rise limit is selected for the filtering of the second setpoint value for the output variable as a function of a response by the means for load-reversal damping to a rise at its input, so that the first component of the second setpoint value for the output variable stipulated by the speed controller is not significantly affected by the filtering on the part of the load-reversal damping component.

Furthermore, it is advantageous if a negligible influencing of the first component of the second setpoint value for the output variable specified by the speed controller by the filtering of the load-reversal damping component is detected if the first component of the second setpoint value for the output variable specified by the speed controller deviates from its original value by less than a specified threshold value, especially by less than 10%. In this way, via suitable setpoint selection of the threshold value, the specification for the determination of the resulting third threshold value for the output variable is able to be specified in a flexible manner.

The speed controller may advantageously be embodied as idle-speed controller.

The second component of the second setpoint value for the output variable specified by the speed controller is able to be formed in an especially uncomplicated manner by subtracting the first component of the second setpoint value for the output variable specified by the speed controller, from the specified second setpoint value for the output variable.

BRIEF DESCRIPTION OF THE DRAWINGS

Exemplary embodiments of the present invention are shown in the figures and explained in greater detail below.

DETAILED DESCRIPTION OF EXAMPLE EMBODIMENTS

Figure 1:
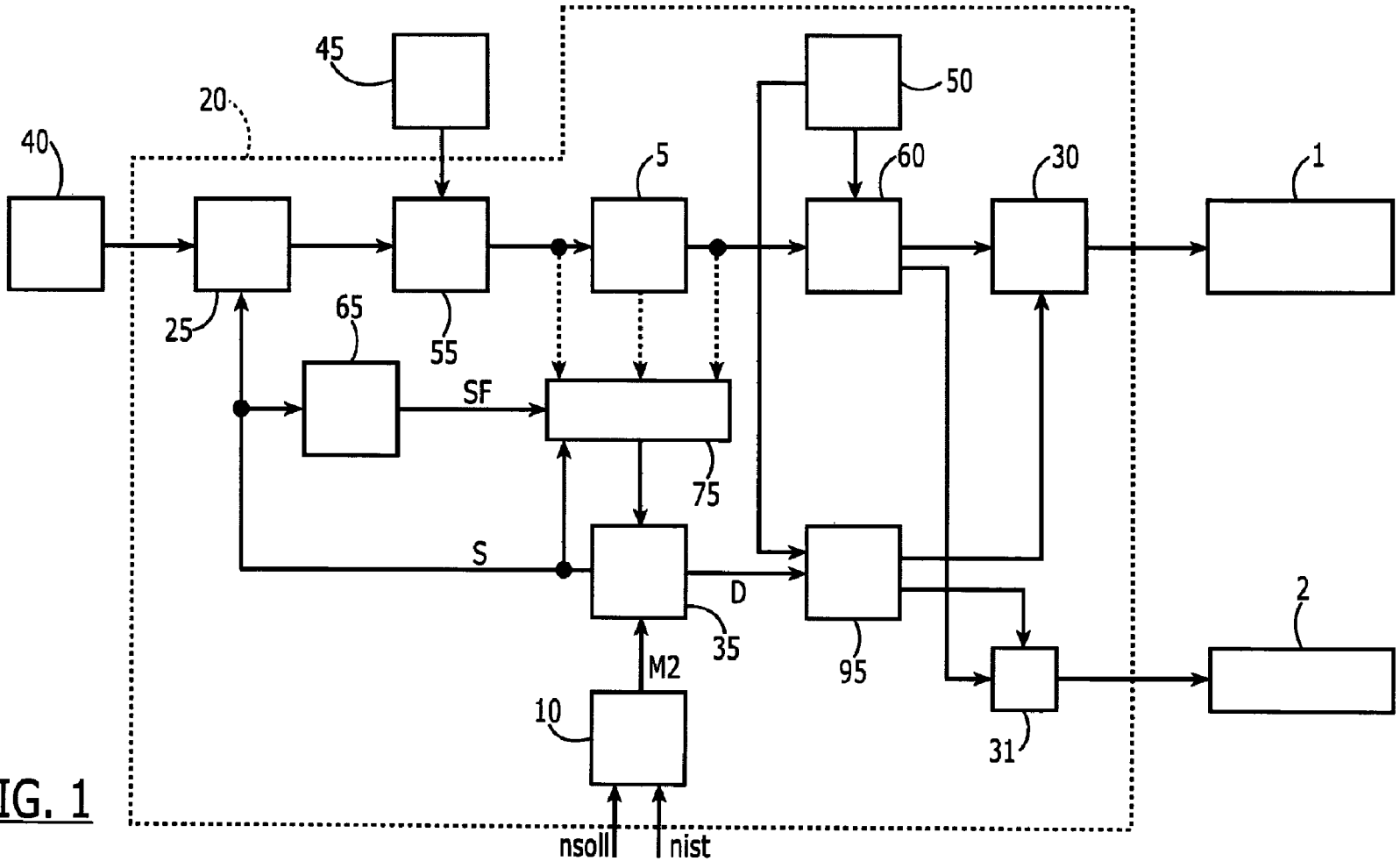
FIG. 1 shows a flow chart to elucidate a method and device according to an example embodiment of the present invention.

In FIG. 1, 1 denotes an electromotor, and 2 denotes a combustion engine. For example, internal combustion engine 2 may take the form of a spark-ignition engine or a diesel engine. Electromotor 1 and combustion engine 2 jointly constitute a common drive of, for instance, a motor vehicle and are also referred to as hybrid drive. In addition, 20 in FIG. 1 denotes an example device according to the present invention, which may be implemented in an engine control of the common drive as software and/or hardware, for example. A drive-pedal module 40 supplies device 20 with a driver-desired value as setpoint value for an output variable of common drive, i.e., common drive unit 1, 2. The output variable may be, for instance, a torque, an output or a variable of common drive unit 1, 2 derived from the torque and/or the output. In the following text it is assumed by way of example that the output variable is a torque of common drive unit 1, 2, so that the driver-desired value at the output of drive-pedal module 40 constitutes a driver-desired torque. In device 20, this is transmitted to a first summing element 25. In addition, first summing element 25 is provided with the output signal of a first division unit 35. From a speed controller 10, first division unit 35 receives a second setpoint value for the output variable of common drive unit 1, 2, i.e., a second setpoint torque M2. For one, speed controller 10 receives a setpoint engine speed nsoll of common drive unit 1, 2, and for another, an instantaneous engine speed nist of common drive unit 1, 2. Instantaneous engine speed nist is determined by an rpm sensor (not shown in FIG. 1) in the region of a crankshaft driven by common drive unit 1, 2. Setpoint engine speed nsoll may be specified as a function of the instantaneous operating state, for example. Speed controller 10 may be embodied as idle-speed controller, for instance. Setpoint engine speed nsoll then is the setpoint idling speed and may amount to 800 or 1000 rotations per minute, for instance. As an alternative, speed controller 10 may also be used for a closed-loop speed control in a start of combustion engine 2 from previous driving with the aid of electromotor 1 using electric power exclusively, in which case a correspondingly higher engine speed than in the case of idling speed is specified as setpoint engine speed nsoll, such as 2000 rotations per minute. Speed controller 10 forms second setpoint torque in such a way that instantaneous engine speed nist is adapted to setpoint engine speed nsoll. In first division unit 35, the second setpoint torque is then split into a first component S and into a second component D. First component S is a stationary component, and second component D is a dynamic component. Stationary component S is added to the driver-desired torque in first summing element 25. Over all, a first setpoint torque therefore results at the output of first summing element 25. This is supplied, either directly or, optionally, via a second summing element 55, to a first filter 5 for load-reversal damping. As shown in FIG. 1, possibly provided second summing element 55 is supplied with a torque-reducing or torque-increasing setpoint selection variable of at least one driver-assistance system 45. A torque-reducing setpoint selection variable has a negative algebraic sign, and a torque-increasing setpoint selection variable has a positive algebraic sign. The at least one driver-assistance system 45 may be designed as, for example, traction control system, electronic stability program, vehicle speed control or the like. A reduced or increased first setpoint torque therefore results at the output of second summing element 55. The first setpoint torque modified in this manner is then forwarded to first filter 5 for load-reversal damping. A filtered first setpoint torque therefore results at the output of first filter 5, which is transmitted to a second division unit 60 in the example of FIG. 1. Second division unit 60 is controlled by a hybrid-strategy setpoint unit 50, which specifies which component of filtered first setpoint torque is to be generated by electromotor 1 and which component of filtered first setpoint torque is to be generated by combustion engine 2. Second division unit 60 therefore outputs a first component of first filtered setpoint torque for electromotor 1 to a third summing element 30, and a second component of the filtered first setpoint torque for combustion engine 2 to a fourth summing element 31. The dynamic component formed by first division unit 35, or second component D, of the second setpoint torque is transmitted to a third division unit 95. Third division unit 95 divides the dynamic component of the second setpoint torque into a first dynamic component for electromotor 1 and into a second dynamic portion for combustion engine 2 as a function of a setpoint of hybrid-strategy setpoint unit 50. The sum of the two dynamic components jointly make up the dynamic component of the second setpoint torque, which is output by first division unit 35. Together, the sum of the two components of the filtered first setpoint torque output by second division unit 60 make up the filtered first setpoint torque at the output of first filter 5 for load-reversal damping. In third summing element 30, the first dynamic component of the second setpoint torque at the output of third division unit 95 is added to the first component of the filtered first setpoint torque in order to form a first component of a resulting third setpoint torque, which is supplied to electromotor 1 for implementation. In fourth summing element 31, the second dynamic component of the second setpoint torque at the output of third division unit 95 is added to the second component of the filtered first setpoint torque in order to form a second component of the resulting third setpoint torque and to forward it to combustion engine 2 for implementation. Overall, the two components of the resulting third setpoint torque jointly form the resulting third setpoint torque to be generated by common drive unit 1, 2.

First division unit 35 is configured for load-reversal damping as a function of at least one characteristic of first filter 5, namely in such a way that the first component of the second setpoint torque formed by first division unit 35 is not or only negligibly affected by the filtering in first filter 5. To this end, FIG. 1 shows a first determination unit 75, which detects at least one characteristic of first filter 5 and configures first division unit 35 according to this at least one characteristic. Furthermore, the first component of the second setpoint torque is supplied as output variable of first division unit 35 to a second filter 65, which represents a copy of first filter 5 and thus has the same configuration as first filter 5. First component SF of second setpoint torque M2 filtered in this manner with the aid of second filter 65 is transmitted to first determination unit 75. First component S of second setpoint torque M2 at the output of first determination unit 35 is likewise transmitted to first determination unit 75. The method of functioning of first determination unit 75 is elucidated in the following text with reference to a flow chart.

Figure 2:
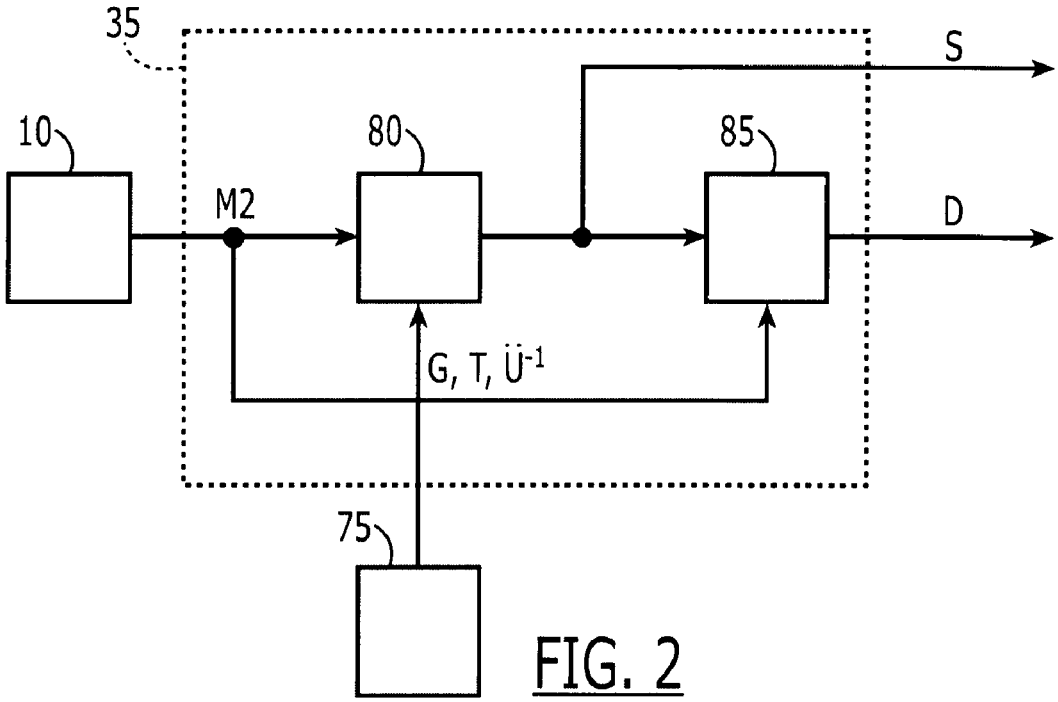
FIG. 2 shows a flow chart for realizing the determination of a stationary and a dynamic component of the second setpoint value for the output variable specified by the speed controller.

FIG. 2 shows first division unit 35 in greater detail in the form of a flow chart. It includes a second determination unit 80 and a subtraction element 85. Second determination unit 80 is provided with the second setpoint torque from speed controller 10. Furthermore, a configuration datum G, T, $\ddot{U}^{-1}$ is supplied to second determination unit 80 by first determination unit 75. Second determination unit 80 therefore is configured as a function of configuration data G, T, $\ddot{U}^{-1}$ of first determination unit 75 and, configured in this manner, determines first stationary component S of second setpoint torque M2 from the second setpoint torque. In subtraction element 85, this is subtracted from the second setpoint torque at the output of speed controller 10. The difference at the output of subtraction element 85 thus constitutes the second, or dynamic, component D of the second setpoint torque.

Figure 4:
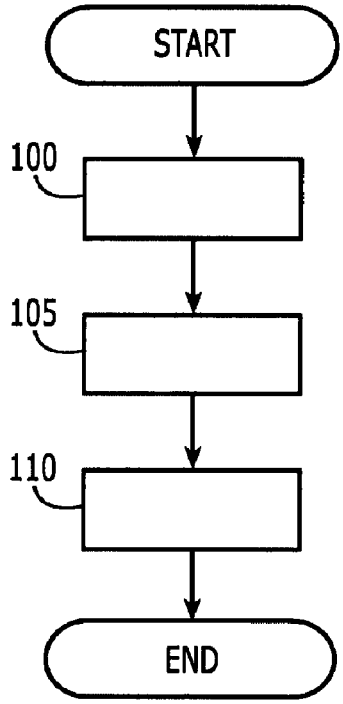
FIG. 4 shows a flow chart for determining a transmission function for a filter to form the first component of the second setpoint value for the output variable specified by the speed controller.

With the aid of FIG. 4, a first alternative for configuring second determination unit 80 is shown in the form of a flow chart. Following the start of the program, first determination unit 75 determines the transmission function of first filter 5 in a program point 100, for instance by dividing the output signal of first filter 5 by the input signal of first filter 5. To this end, as shown in FIG. 1 by the dashed line, the output signal of first filter 5 and the input signal of first filter 5 are forwarded to first determination unit 75. Subsequently, branching to a program point 105 takes place.

In program point 105, first determination unit 75 inverts the determined transmission function. Subsequently, branching to a program point 110 takes place.

In program point 110, first determination unit 75 transmits inverted transmission function $\ddot{U}^{-1}$ to second determination unit 80 and initiates the implementation of inverted transmission function $\ddot{U}^{-1}$ in second determination unit 80, so that the transmission function of second determination unit 80 corresponds to inverted transmission function $\ddot{U}^{-1}$. This implementation of inverted transmission function $\ddot{U}^{-1}$ in second determination unit 80 may be implemented purely in software. Stationary component S of second setpoint torque M2 thus results through application of inverted transmission function $\ddot{U}^{-1}$ to second setpoint torque M2 by second determination unit 80. The program is left following program point 110.

Figure 5:
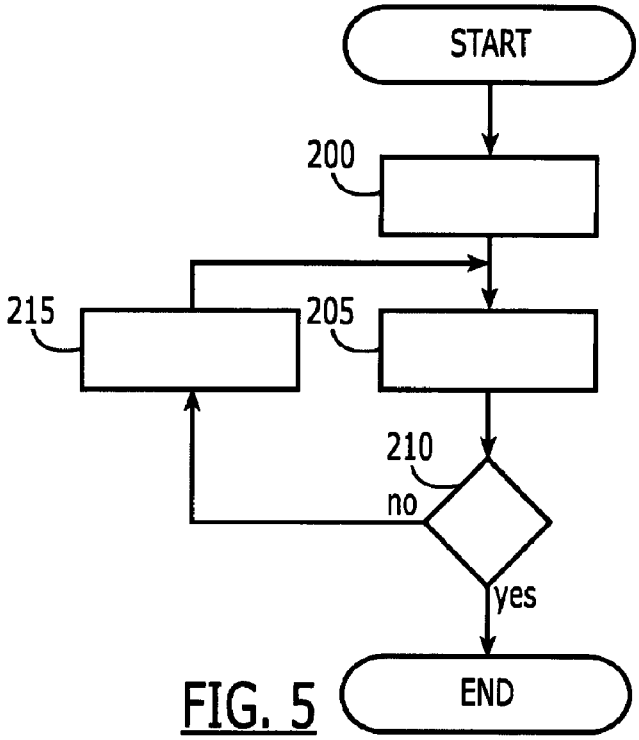
FIG. 5 shows a flow chart for determining a time constant of such a filter and/or a rise limit for determining the first component of the second setpoint value for the output variable specified by the speed controller.

According to an alternative specific embodiment, second determination unit 80 is configured with the aid of the second flow chart according to FIG. 5. In the following, it is to be assumed by way of example that second determination unit 80 is structured according to the flow chart of FIG. 3. Second determination unit 80 includes a rise limiter 90 and a third filter 15. Third filter 15 is configured as low pass, for example, preferably as proportional time element of the first order (PT1 element). Speed controller 10 supplies rise limiter 90 with second setpoint torque M2. Rise limiter 90 limits the amount of the time gradient of second setpoint torque M2 to a setpoint limit value G, which must not be exceeded. In contrast, time gradients of second setpoint torque M2 that are smaller in their amount are not limited by rise limiter 90. Second setpoint torque M2 at the output of rise limiter 90 obtained in this manner and possibly limited in its time gradient by rise limiter 90, is then forwarded to low pass 15 using time constant T. The low-pass filtered output signal of low pass 15 then constitutes stationary component S of second setpoint torque M2.

For example, second determination unit 80 is configured with the aid of the flow chart according to FIG. 5 by first determination unit 75. In this configuration, limit value G and/or time constant T is/are configured. Following the start of the program, first determination unit 75 sets limit value G and/or time constant T to a start value. The start value for limit value G is selected as large as possible, for example according to an angle of inclination of 90°, which corresponds to an infinite rise. The start value for time constant T may be selected as small as possible, e.g., equal to zero. Subsequently, branching to a program point 205 takes place.

In program point 205, second setpoint torque M2 is forwarded to second determination unit 80 according to a specified time characteristic, for example according to a step function, and converted into stationary component S of second setpoint torque M2 according to the instantaneously configured limit value G and/or the instantaneously configured time constant T. It is supplied as filtered stationary component SF to first determination unit 75, directly on the one hand, and following filtering by copy 65 of first filter 5 on the other hand. Subsequently, branching to a program point 210 takes place.

In program point 210, first determination unit 75 checks whether filtered stationary component SF deviates from stationary component S by less than a setpoint threshold value, e.g., by less than 10%. The setpoint threshold value may be selected on a test stand, for example, in such a way that stationary component S is not or only negligibly affected by first filter 5 or its copy 65. This is usually satisfied for the selection of the setpoint threshold smaller than or equal to 10%. If this is the case, then the program is left and the instantaneous configuration of second determination unit 80 is retained; otherwise, branching to a program point 215 takes place.

In program point 215, first determination unit 75 reduces limit value G from its instantaneous value by a setpoint decrement, and/or it increases time constant T from its instantaneous value by a setpoint increment. This forms a new instantaneous limit value G and/or an new instantaneous time constant T. Subsequently, branching back to a program point 205 occurs.

The setpoint time curve of second setpoint torque M2 specified for the configuration of second determination unit 80 is advantageously selected in such a way that it covers an extreme case of load reversal to be damped in order to enable a correct division into the stationary and the dynamic component of second setpoint torque M2 in all operating situations of common drive unit 1, 2.

In the event that both limit value G and time constant T are configured, the division into stationary component S and dynamic component D is able to be realized in an especially precise manner. However, with a fixedly specified time constant T that is greater than zero, it already suffices to configure only limit value G in the described manner or, with a fixedly specified limit value G that is smaller than 90°, to configure only time constant T in the described manner. Furthermore, second determination unit 80 may optionally also encompass only rise limiter 90 or only third filter 15. If second determination unit 80 includes only rise limiter 90, then this is synonymous with the configuration shown in FIG. 3 and a time constant T equal to zero. On the other hand, if second determination unit 80 includes only filter 15, then this is synonymous with the configuration shown in FIG. 3, and G is equal to a 90° rise.

Figure 3:
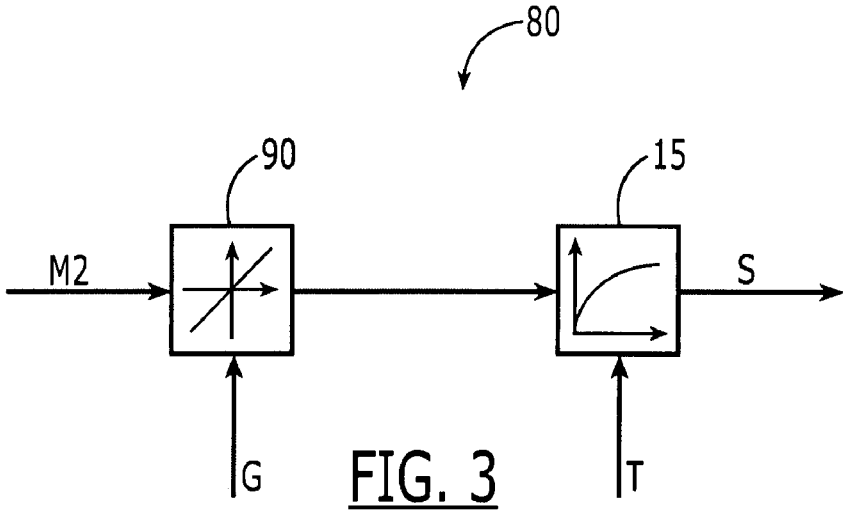
FIG. 3 shows a flow chart of a determination unit for determining the stationary component of the second setpoint value for the output variable specified by the speed controller.

If the time constant of first filter 5 and/or the rise limit of first filter 5 in first determination unit 75 is known, for example because of information from the manufacturer of first filter 5, then the configuration of second determination unit 80 by first determination unit 75 is also implementable in such a way that time constant T of second determination unit 80 according to FIG. 3 is selected greater than the time constant of first filter 5, and/or limit value G of second determination unit 80 is selected smaller or equal to the rise limit value of first filter 5. This ensures that stationary component S filtered by second determination unit 80 is not changed significantly by first filter 5. In this specific embodiment, as well, it is possible again to configure second determination unit 80 both with rise limiter 90 and also with low pass filter 15 according to FIG. 3 and to configure both limit value G as well as time constant T in the manner described. This makes it possible to determine stationary component S as precisely as possible. However, starting from the corresponding value of first filter 5, it is also possible to configure only limit value G in the described manner given a fixedly specified time constant T that is greater than zero, or to configure only time constant T given a fixedly specified limit value G of less than 90°. Even more expense can be saved if second determination unit 80 includes only rise limiter 90 having a correspondingly configured limit value G, or only low pass filter 15 having a correspondingly configured time constant T. In the configuration of time constant T it has shown to be advantageous if it is selected much larger than the time constant of first filter 5. For example, it was found that a sufficiently precise determination of stationary component S is possible if time constant T is larger than the time constant of first filter 5 by at least the factor of 10.

The use of low-pass filter 15 in second determination unit 80 provides the additional advantage that dynamic component D lying at the output of subtraction element 85, averaged over one driving cycle of common drive unit 1, 2, is average-value-free. In this way the load strategy of electromotor 1 is not falsified and it is prevented that a battery of common drive unit 1, 2 is discharged by a false permanent setpoint component at electromotor 1.

The intervention of the at least one driver-assistance system 45 via second summing element 55 is not essential for the present invention so that it may also be omitted.

In the same way the present invention is also applicable to a pure electromotor or a pure combustion engine, so that hybrid-strategy setpoint unit 50 and second division unit 60 as well as third division unit 95 may be omitted in this case. In the event that the drive unit includes only electromotor 1, then the output signal of first filter 5 is added in third summing element 30 to dynamic component D at the output of first division unit 35, and the output signal of third summing element 30 is specified as resulting third setpoint torque for electromotor 1. Fourth summing element 31 is not necessary in this case.

In the event that the drive unit includes only combustion engine 2, the output signal of first filter 5 is added in fourth summing element 31 to dynamic component D at the output of first division unit 35. The sum at the output of fourth summing element 31 then is the resulting third setpoint torque, which is specified for combustion engine 2. Third summing element 30 is not required in this case.

The method and device according to the example embodiment of the present invention ensure that stationary component S of second setpoint torque M2 is taken into account in the load-reversal damping with the aid of first filter 5, stationary component S being formed from second setpoint torque M2 in such a way that it is not or only negligibly affected by the filtering for load-reversal damping with the aid of first filter 5. Dynamic component D is first taken into account in the formation of the resulting third setpoint torque, so that this dynamic component D is unable to be adversely affected by the filtering for load-reversal damping with the aid of first filter 5. According to the example embodiment of the present invention, stationary component S of the second setpoint torque is therefore incorporated by coordination right at the beginning of the torque loop, i.e., in first summing element 25, and dynamic component D of second setpoint torque M2 is incorporated all the way at the end of the torque loop in third summing element 30 or in fourth summing element 31, in the manner described.

This makes it possible to consider stationary component S of second setpoint torque M2 in the load-reversal damping and possibly in the action of at least one driver-assistance system 45, and/or for the implementation of a hybrid strategy by splitting the setpoint torque between electromotor 1 and combustion engine 2, without thereby adversely affecting stationary component S of second setpoint torque M2, and therefore without adversely affecting second setpoint torque M2 by the load-reversal damping, by the at least one driver-assistance system 45, and by the hybrid strategy to be implemented.

In addition, a torque-increasing or torque-decreasing intervention of a transmission control with the aid of an additional summing element may be provided in the torque loop between first summing element 25 and first filter 5, so that stationary component S is taken into account for such an intervention, as well. Such a transmission intervention is provided, for instance, in a gear-shift operation in the case of an automatic transmission.

What is claimed is:

1. A method for operating a drive unit of a motor vehicle, having a component adapted for load-reversal damping, which filters a first setpoint value for an output variable of the drive unit so as to damp a load reversal, and a speed controller, which specifies a second setpoint value for an output variable of the drive unit in order to adjust an actual value for an engine speed of the drive unit to a setpoint value for the engine speed, the method comprising:

forming the first setpoint value including taking into account a first component of the second setpoint value for the output variable specified by the speed controller; and taking into account a remaining second component of the second setpoint value for the output variable specified by the speed controller together with the filtered first setpoint value only in the formation of a resulting third setpoint value for the output variable;

wherein the first component of the second setpoint value for the output variable specified by the speed controller is formed as a function of at least one characteristic of the component adapted for load-reversal damping, in such a way that it is not or only negligibly affected by the filtering.

2. The method as recited in claim 1, wherein the first component of the second setpoint value for the output variable specified by the speed controller is formed by filtering the second setpoint value for the output variable.

3. The method as recited in claim 2, wherein the filtering is implemented with the aid of a low pass filter.

4. The method as recited in claim 3, wherein the filtering is implemented using a proportional time element.

5. The method as recited in claim 2, wherein a transmission function that is inverse to a transmission function of the component adapted for load-reversal damping is selected for the filtering of the second setpoint value for the output variable.

6. The method as recited in claim 2, wherein a time constant that is at least ten times greater than a time constant of the filtering induced by the component adapted for load-reversal damping is selected for the filtering of the second setpoint value for the output variable, so that the first component of the second setpoint value for the output variable specified by the speed controller is not significantly affected by the filtering by the component adapted for load-reversal damping.

7. The method as recited in claim 2, wherein a rise limit as a function of a response by the component adapted for load-reversal damping to a rise limitation at its input is selected for the filtering of the second setpoint value for the output variable, so that the first component of the second setpoint value for the output variable specified by the speed controller is not significantly affected by the filtering by the component adapted for load-reversal damping.

8. The method as recited in one claim 1, wherein an insignificant influencing of the first component of the second setpoint value for the output variable specified by the speed controller by the filtering by the component adapted for load-reversal damping is detected when the first component of the second setpoint value for the output variable specified by the speed controller deviates from its original value by less than a specified threshold value due to the filtering by the component adapted for load-reversal damping.

9. The method as recited in claim 8, wherein the insignificant influencing is detected when the first component of the second setpoint value for the output variable specified by the speed controller deviates by less than 10% from its original value.

10. The method as recited in claim 1, wherein an idle-speed controller is used as speed controller.

11. The method as recited in claim 1, wherein the second component of the second setpoint value for the output variable specified by the speed controller is formed by subtracting the first component of the second setpoint value for the output variable specified by the speed controller from the specified second setpoint value for the output variable.

12. A device for operating a drive unit of a motor vehicle, comprising:

a component adapted for load-reversal damping which filters a first setpoint value for an output variable of the drive unit so as to damp a load reversal;

a speed controller which specifies a second setpoint value for the output variable of the drive unit in order to adjust an actual value for an engine speed of the drive unit to a setpoint value for the engine speed;

a component adapted to consider a first component of the second setpoint value for the output variable specified by the speed controller in the formation of the first setpoint value;

a component adapted to consider a remaining second component of the second setpoint value for the output variable specified by the speed controller together with the filtered first setpoint value only when forming a resulting third setpoint value for the output variable; and a component adapted to form the first component of the second setpoint value for the output variable specified by the speed controller, which form the first component of the second setpoint value for the output variable specified by the speed controller as a function of at least one characteristic of the component adapted for load-reversal damping in such a way that it is not, or only negligibly, affected by the filtering.

* * * * *